US010260306B1

(12) United States Patent
Beckett et al.

(10) Patent No.: US 10,260,306 B1
(45) Date of Patent: Apr. 16, 2019

(54) CASING WIPER PLUG SYSTEM AND METHOD FOR OPERATING THE SAME

(71) Applicant: GRYPHON OILFIELD SOLUTIONS, LLC, Houston, TX (US)

(72) Inventors: Ian Beckett, Houston, TX (US); Tyler Roberts, Houston, TX (US); Geoff Williams, Houston, TX (US)

(73) Assignee: Gryphon Oilfield Solutions, LLC, Houston, TX (US)

( * ) Notice: Subject to any disclaimer, the term of this patent is extended or adjusted under 35 U.S.C. 154(b) by 0 days.

(21) Appl. No.: 16/055,655

(22) Filed: Aug. 6, 2018

Related U.S. Application Data

(60) Provisional application No. 62/593,857, filed on Dec. 1, 2017.

(51) Int. Cl.

| | |
|---|---|
| ***E21B 33/16*** | (2006.01) |
| ***E21B 33/08*** | (2006.01) |
| ***E21B 34/06*** | (2006.01) |
| ***E21B 33/124*** | (2006.01) |

(52) U.S. Cl.
CPC ..... *E21B 33/08* (2013.01); *E21B 33/124* (2013.01); *E21B 33/16* (2013.01); *E21B 34/063* (2013.01)

(58) Field of Classification Search
CPC ..... E21B 33/16; E21B 47/0006
See application file for complete search history.

(56) References Cited

U.S. PATENT DOCUMENTS

| | | | | |
|---|---|---|---|---|
| 3,076,509 | A | 2/1963 | Burns et al. | |
| 3,412,797 | A * | 11/1968 | Huitt | E21B 37/08 166/155 |
| 5,181,571 | A * | 1/1993 | Mueller | E21B 7/04 166/381 |
| 5,191,932 | A * | 3/1993 | Seefried | E21B 33/16 166/155 |
| 5,709,269 | A | 1/1998 | Head | |
| 6,561,270 | B1 * | 5/2003 | Budde | E21B 33/16 166/153 |
| 7,322,417 | B2 | 1/2008 | Rytlewski et al. | |
| 8,201,634 | B2 * | 6/2012 | Laurel | E21B 33/16 166/153 |
| 8,276,670 | B2 | 10/2012 | Patel | |
| 9,016,388 | B2 | 4/2015 | Kellner et al. | |
| 9,410,399 | B2 * | 8/2016 | Andersen | E21B 34/14 |
| 9,518,440 | B2 | 12/2016 | Sanchez et al. | |
| 2007/0181224 | A1 | 8/2007 | Marya et al. | |

(Continued)

*Primary Examiner* — Shane Bomar
(74) *Attorney, Agent, or Firm* — Winston & Strawn LLP

(57) ABSTRACT

The present casing wiper plug system and method includes a novel top wiper plug and a dissolvable blocking element. The top wiper plug includes a rupture disk and an open tail section configured and dimensioned to receive the dissolvable blocking element. The blocking element can be dissolved by a solvent and can dissolve quickly given the size or materials of the blocking element. When used in conjunction with a bottom wiper plug and a displacement fluid, the central bores of the top and bottom wiper plugs and shoe track provide an open passage to the formation allowing future injection or fracking fluid to access the formation. The blocking element is released into a seat of the open tail section to temporarily block the passage so a casing test can be performed on the casing. After the test is complete, the blocking element is dissolved to reopen the passage.

14 Claims, 8 Drawing Sheets

(56) References Cited

U.S. PATENT DOCUMENTS

| | | | | |
|---|---|---|---|---|
| 2013/0240201 | A1* | 9/2013 | Frazier | E21B 33/134<br>166/135 |
| 2018/0051533 | A1* | 2/2018 | Zbranek | E21B 33/134 |
| 2018/0112488 | A1* | 4/2018 | Budde | E21B 23/01 |

* cited by examiner 180024-4100

CASING WIPER PLUG SYSTEM AND METHOD FOR OPERATING THE SAME

This application claims the benefit of provisional application 62/593,857 filed Dec. 1, 2017, the entire content of which is expressly incorporated herein by reference thereto.

FIELD OF THE INVENTION

The present invention relates generally to the field of oilfield exploration, cementing, production, and testing, and more specifically to a casing wiper plug system for wet shoe and casing pressure test and a method for operating the same.

BACKGROUND OF THE INVENTION

Currently, there are several ways to cement a production casing. One way is to employ a wiper plug system that includes a top wiper plug having a closed top end and drop the system into the casing. This method, however, leaves a closed system within the casing requiring a tubing conveyed perforation gun to blow through the casing and the cement between the casing and the hydrocarbon reservoir or formation in order for future injection or fracking fluid to access the formation.

Another way is to employ a wiper plug system, install a toe sleeve or toe valve on the downhole end of the casing, and drop the system into casing allowing the system to pass through the toe sleeve and the toe sleeve to slide behind the system. This method leaves a closed system allowing pressure to be applied against the closed top of the top wiper plug to achieve a casing pressure test. Another pressure is then applied over that of the casing pressure test to open the toe sleeve. An open toe sleeve allows injection or fracking fluid to access the formation. Although this method eliminates the use of a tubing conveyed perforation gun, it still requires installing toe sleeve toward the end of the casing and a subsequent pressure application to access the formation.

The different methods that have been employed while somewhat useful still have shortcomings such that there remains a need for further improvements in casing wiper plug systems. These are now provided by the present invention.

SUMMARY OF THE INVENTION

One embodiment of the present invention relates to a top wiper plug for well bore casing applications. The top wiper plug comprises a body having one or more wiper fins extending therefrom, a central bore having entry and exit apertures, a rupture disk for initially closing off the central bore, and an open tail section that includes an interior structure that narrows from a wider end at the open tail section to a narrower end at a seat structure adjacent the entry aperture of the central bore. The tail section is advantageously configured and dimensioned to receive therein a dissolvable blocking element configured to fit in the narrower end of the interior structure and seat to block the entry aperture of the central bore, where the blocking element is dissolvable by a solvent. Preferably, the open tail section of the top wiper plug has a conical interior structure.

The top wiper plug can also include a sealing nose configured to be connected with a bottom wiper plug that is configured to be connected with a landing collar.

The invention also relates to a combination comprising the top wiper plug disclosed herein and a dissolvable blocking element that is received in the seat structure. Preferably, the dissolvable blocking element has a diameter that is larger than but no greater than 1½ times the diameter of the central bore of the top wiper plug so that the blocking element is sufficiently large to block the central bore but sufficiently small to be dissolved readily.

The invention also relates to a system and method for conducting a mechanical integrity test to determine whether a wellbore casing can withstand fracking conditions.

The system comprises a bottom wiper plug; a top wiper plug as disclosed herein; and a dissolvable blocking element configured to fit in the narrower end of the interior and seat structures to block to block the entry aperture of the central bore, where the blocking element is dissolvable by a solvent. The bottom wiper plug advantageously comprises a body having one or more wiper fins extending therefrom, a central bore having entry and exit apertures, a rupture disk for initially closing off the central bore, a sealing nose configured to be connected to a landing collar, and a plug connector configured receive a forward portion of the top wiper plug.

The rupture disks of the top and bottom wiper plugs are initially configured to prevent fluids from passing through the central bores of the respective plugs. These disks are breakable by fluids or fluid pressure to open the respective bores of the plugs when necessary. This allows the central bores to be cleaned prior to operating the well.

The method of the present invention includes introducing into a wellbore casing a top wiper plug as disclosed herein; and then introducing a dissolvable blocking element into the open tail section of the top wiper plug to temporarily block the central bore of the top wiper plug in order to allow the mechanical integrity test to be conducted. The dissolvable blocking element is removable after the test is conducted by introducing a solvent into the wellbore casing that dissolves the dissolvable blocking element. Preferably, the solvent is water or an aqueous solvent.

Before introducing the dissolvable blocking element, the rupture disk of the top wiper plug may be ruptured to allow fluids to pass through the top wiper plug for cleaning of the central bore. And after the test is completed, the dissolvable blocking element is dissolved to re-open the central bore of the top wiper plug to allow fluids to flow through the central bore.

This method can additionally include initially introducing a bottom wiper plug into the wellbore casing; and introducing a cement slurry into the wellbore casing after the bottom wiper plug is introduced and before the top wiper plug is introduced so that the cement slurry can be delivered to cement the wellbore casing to the wellbore. The bottom wiper plug can be conventional but preferably has the structure disclosed herein.

The method includes rupturing the rupture disk of the bottom wiper plug at a selected burst pressure to open the central bore to allow fluids to pass therethrough. In particular, the rupture disk of the bottom wiper plug is ruptured prior to before the forward portion of the top wiper plug is received by the plug connector of the bottom wiper plug to allow fluids to pass therethrough.

BRIEF DESCRIPTION OF THE DRAWING FIGURES

Various features of examples in accordance with the principles described herein may be more readily understood with reference to the following detailed description taken in conjunction with the accompanying drawings, where like reference numerals designate like structural elements, and in which.

Figure 1:
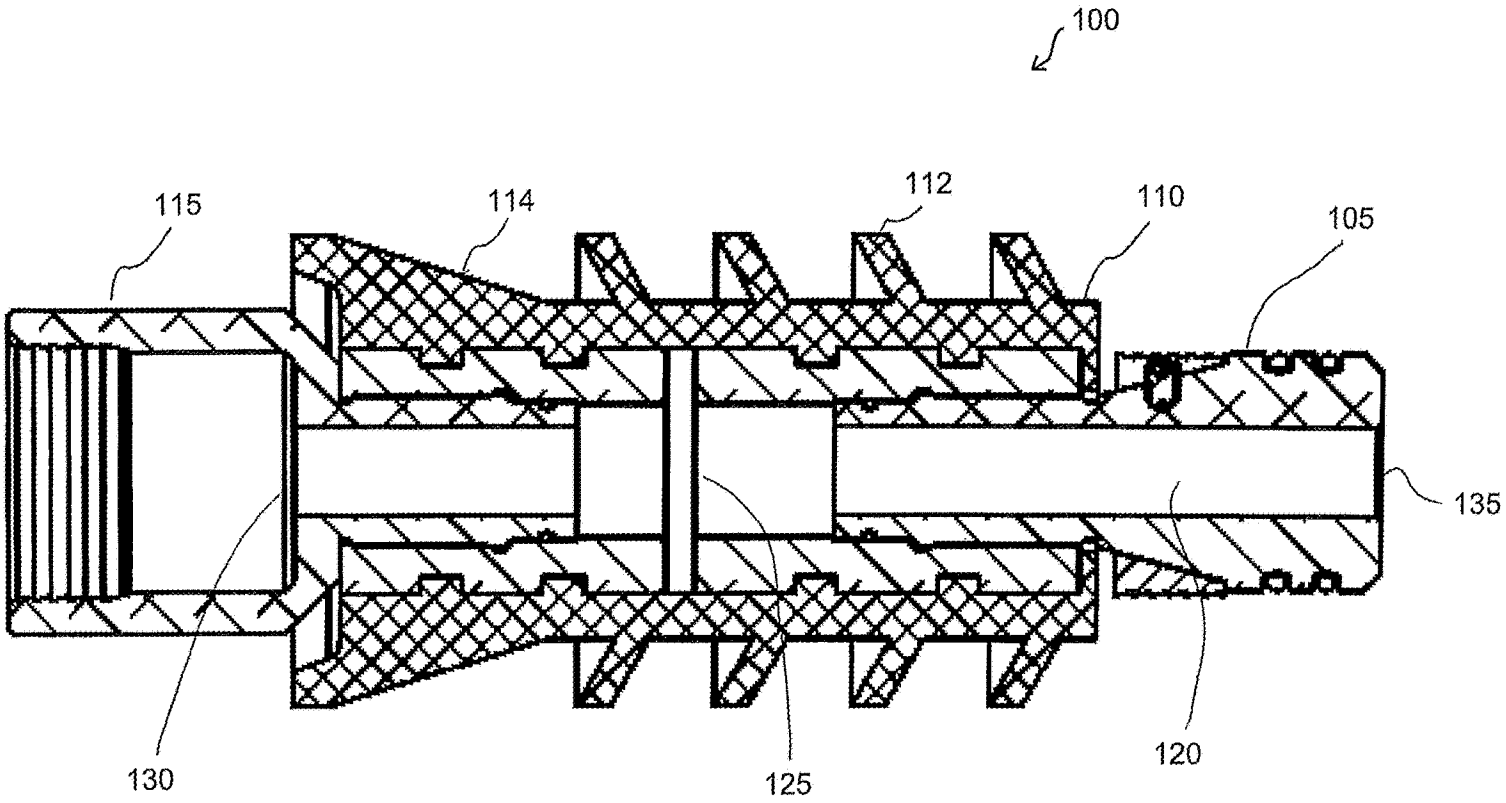
FIG. 1 depicts an illustrative bottom wiper plug 100 in accordance with some embodiments of the present invention.
Figure 2:
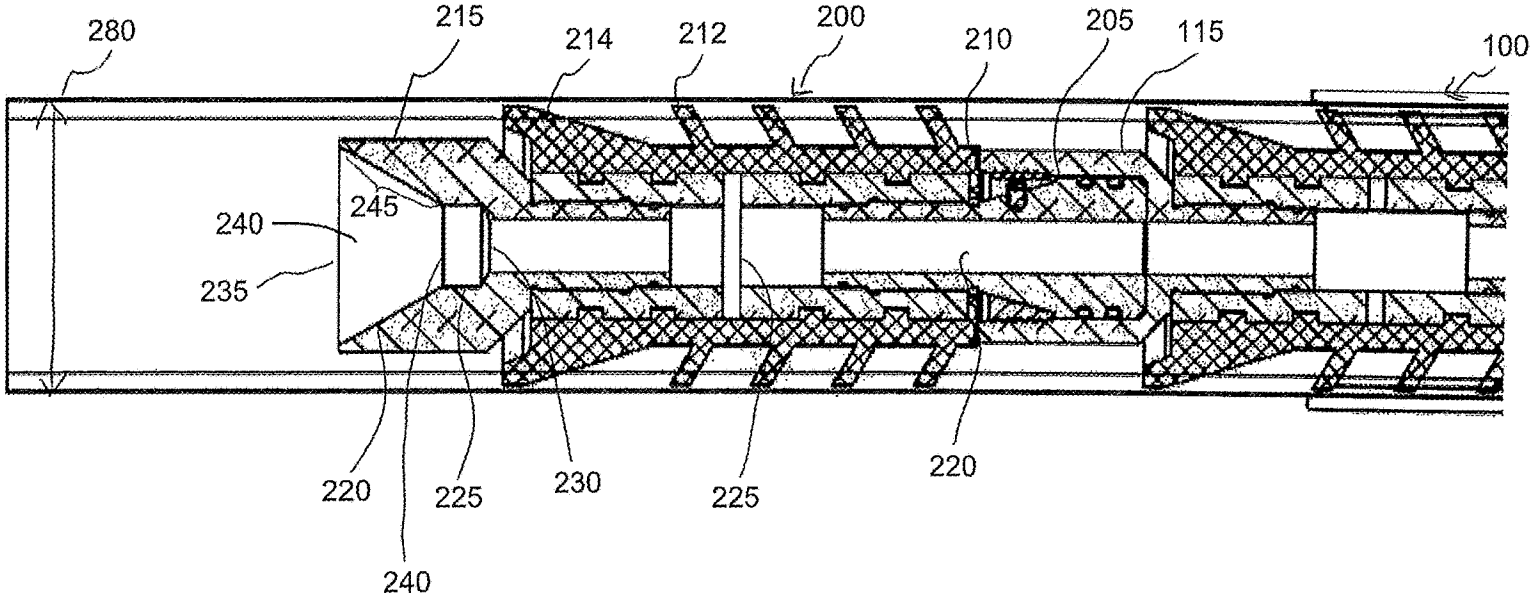
FIG. 2 depicts an illustrative top wiper plug 200 in accordance with some embodiments of the present invention.
Figure 3:
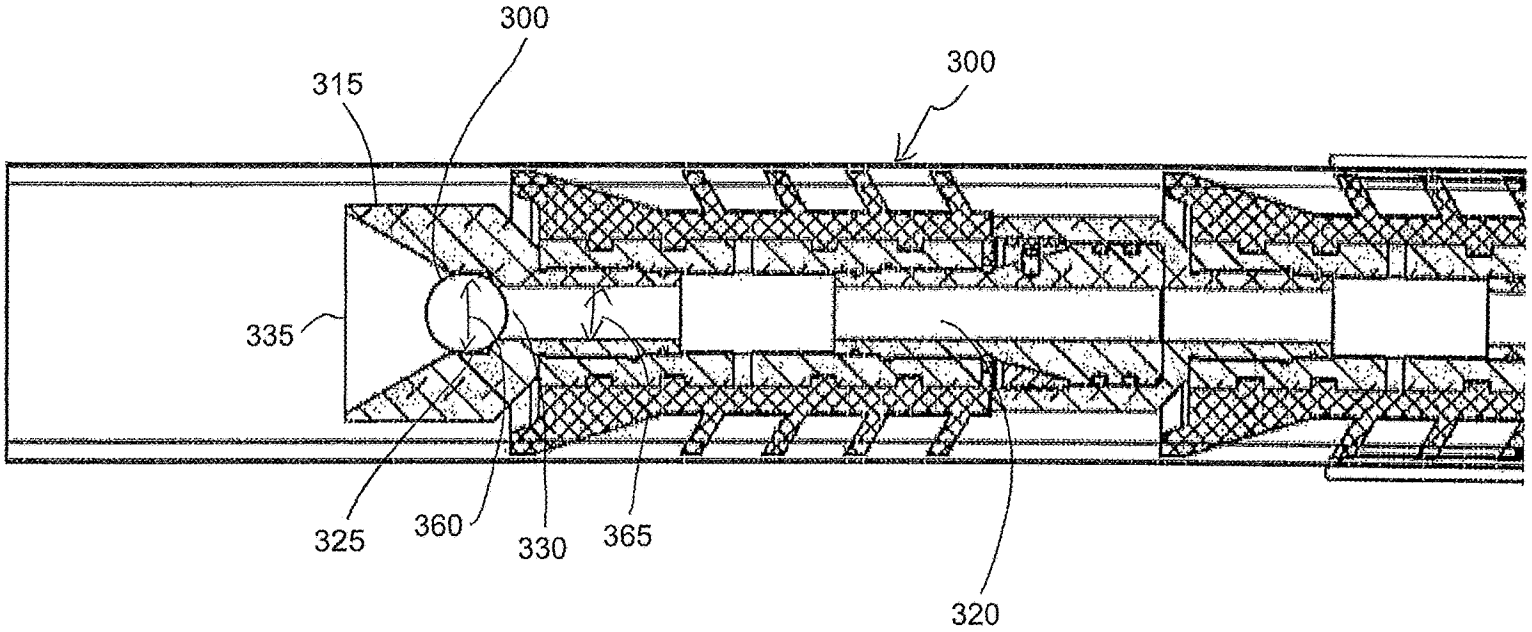
FIG. 3 depicts an illustrative blocking element 300 in a top wiper plug 200 in accordance with some embodiments of the present invention.
Figure 5:
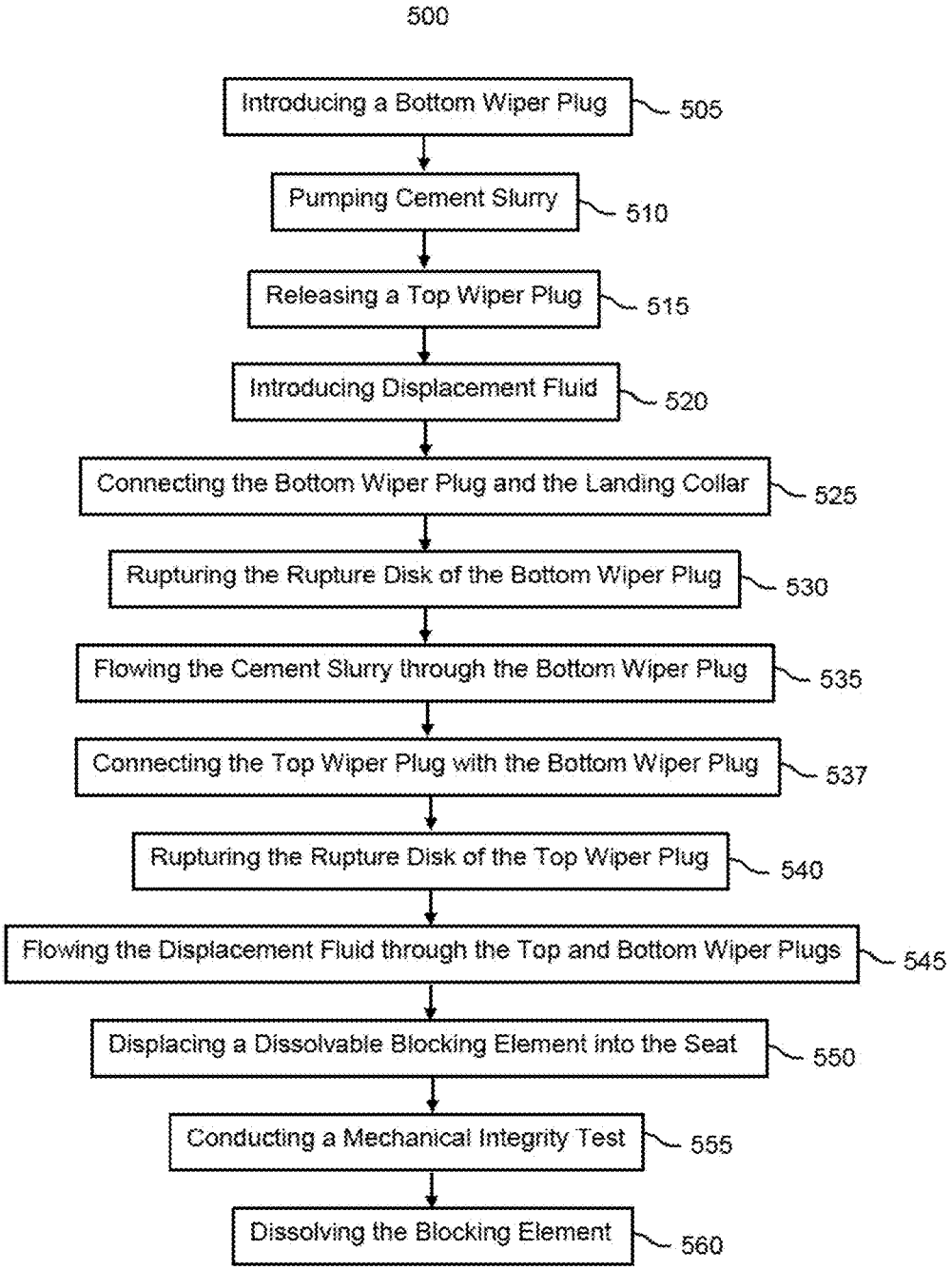
Figure 6A:
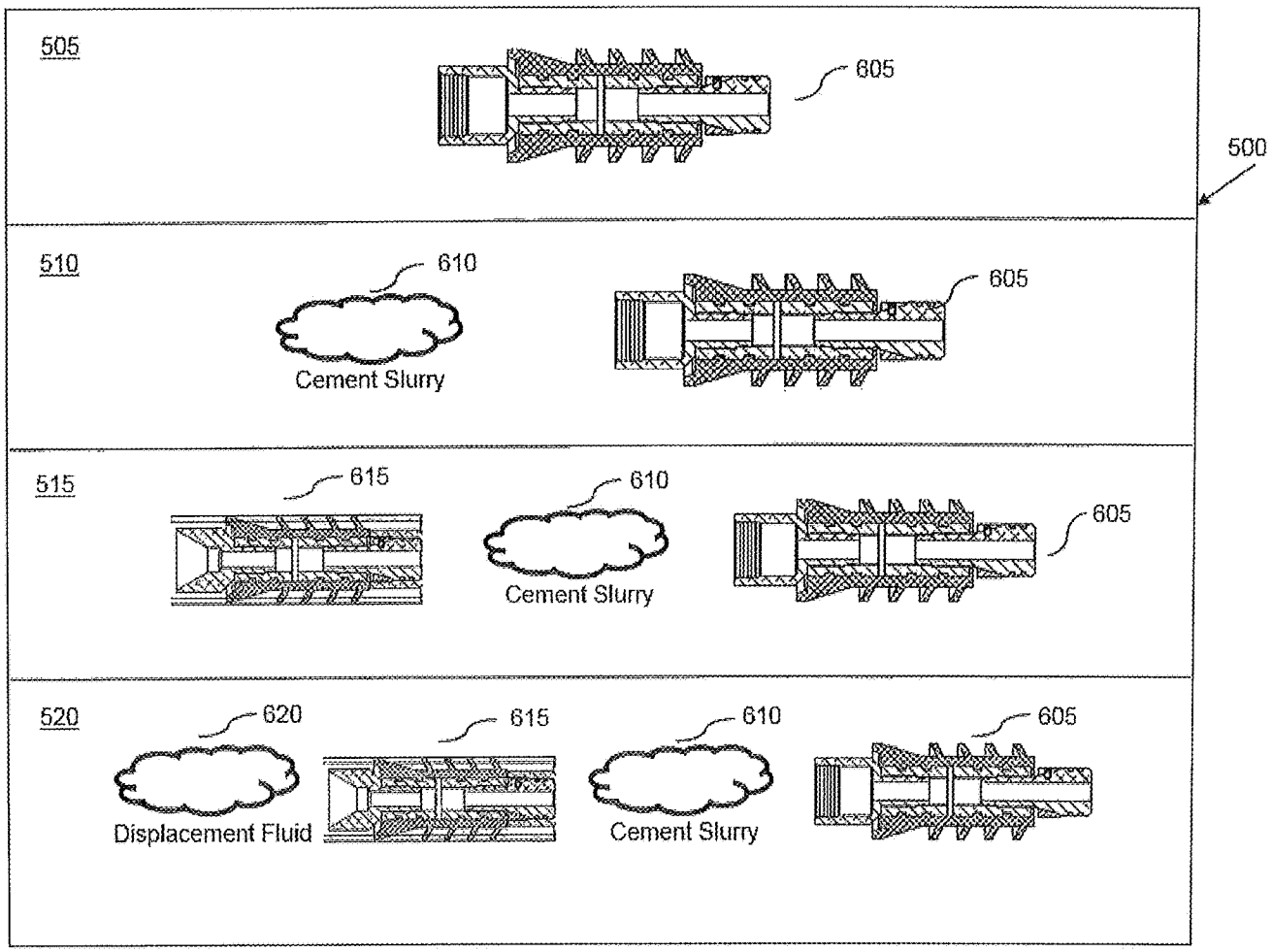
Figure 6B:
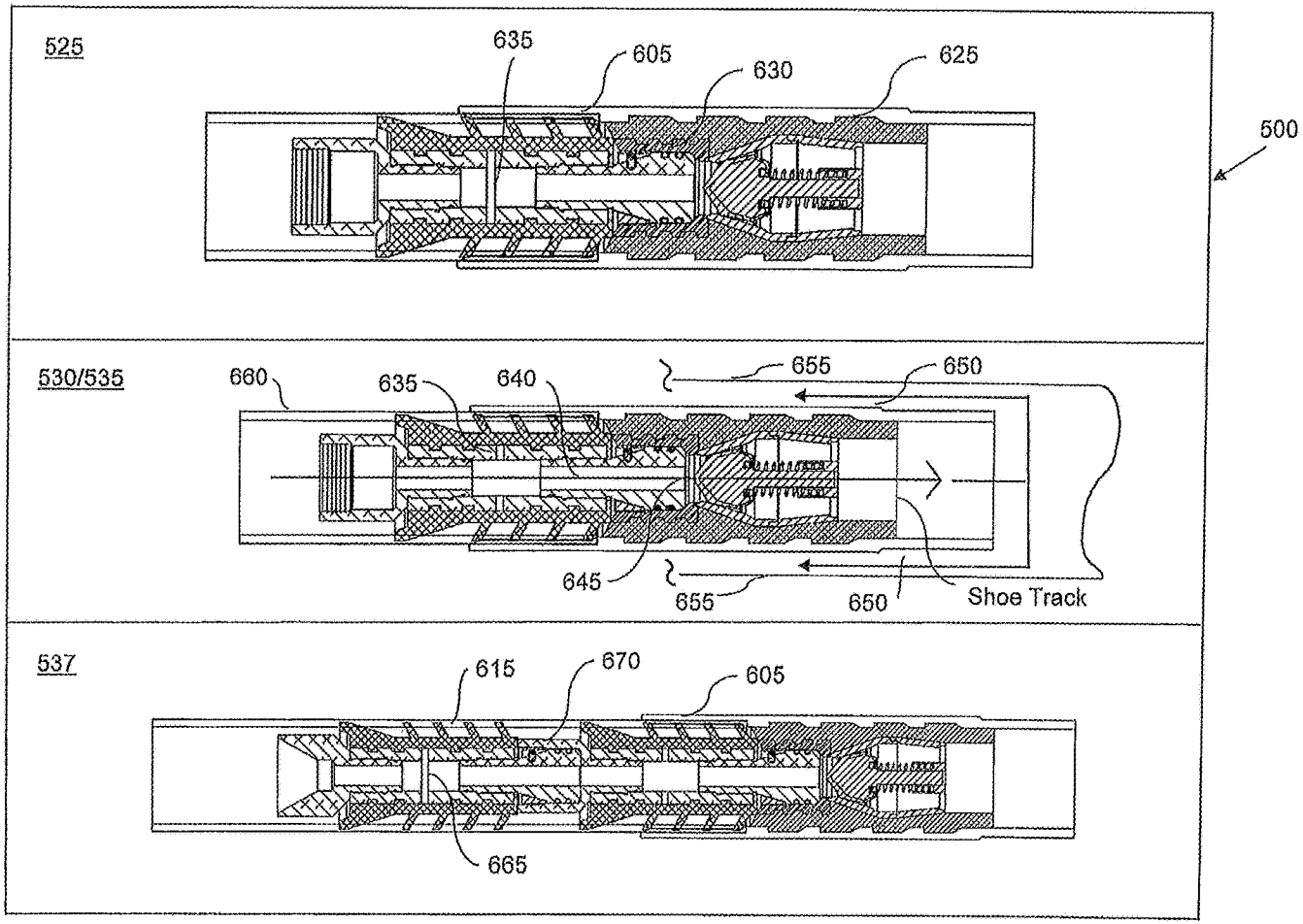
Figure 6C:
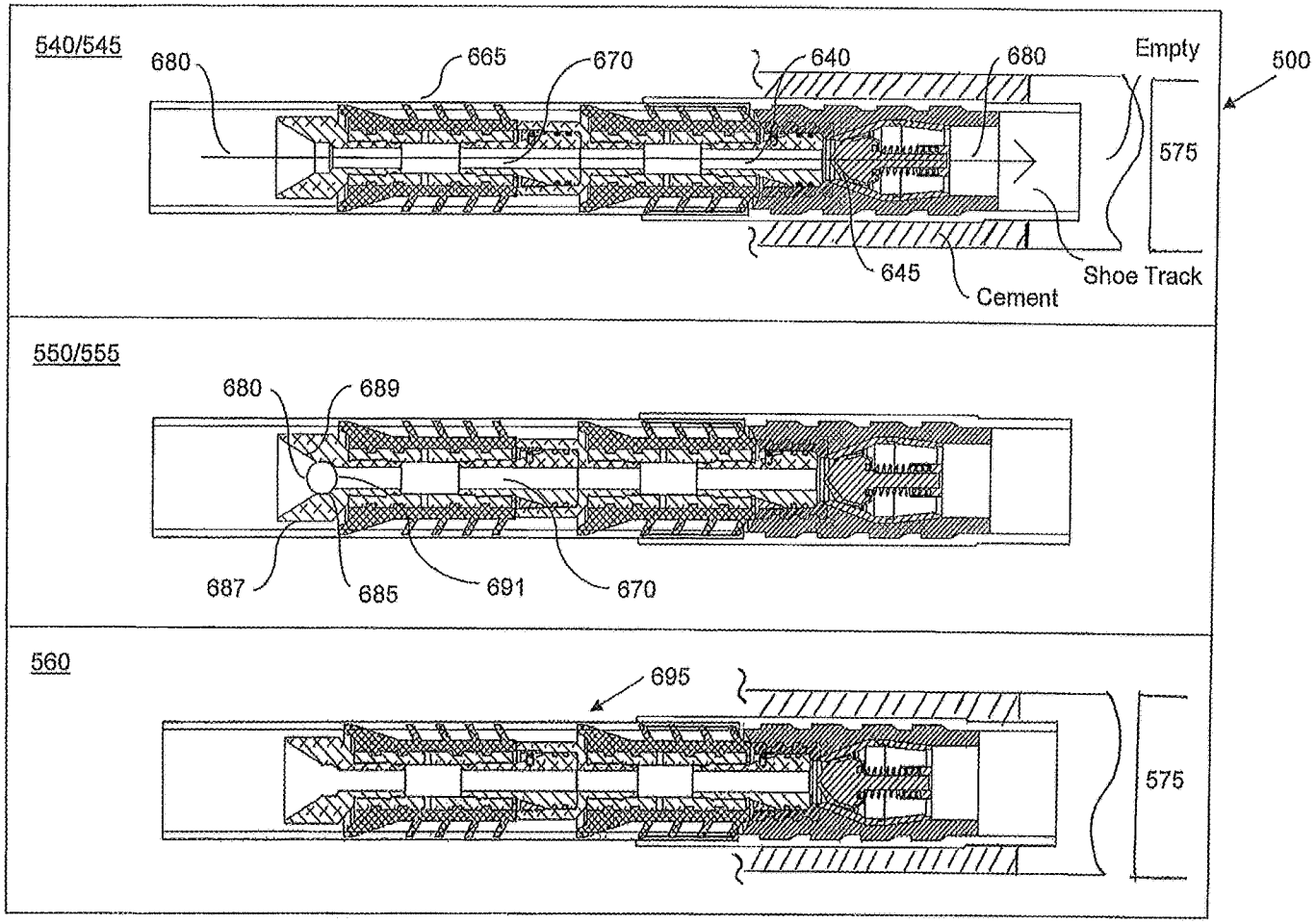

FIG. 5 shows an illustrative flow chart of the method for operating the bottom wiper plug, top wiper plug, and dissolvable blocking element in accordance with some embodiments of the present invention; and FIGS. 6A, 6B and 6C show a pictorial flow chart corresponding to the flow chart in FIG. 5 using the actual components illustrated in FIGS. 1-3 in accordance with some embodiments of the present invention.

DETAILED DESCRIPTION OF THE INVENTION

The casing wiper plug system and method of the present invention allow for a wet shoe to be pumped and provides means to perform a casing test through the use of a specially configured to wiper plug in connection with a dissolvable blocking element, preferably one that is configured as a ball. As noted above, with a conventional wet shoe process, there is no means of testing the integrity of the production casing after delivering the cement. The newly developed casing wiper plug system provides a place for the dissolvable ball to seat in order to conduct the casing test. Once the cement has cured and access to the formation has been established by pumping fluid out of the float shoe, the dissolvable ball is dropped from surface where it is displaced into the seat in the casing wiper plug. Pressure is then increased to test the mechanical integrity of the production casing. Once the casing test has been performed, a period of time passes in which the ball contacts an aqueous fluid and is allowed to dissolve. With the ball no longer blocking fluid access to the float shoe, injection into the formation can once again be re-established.

The present invention is to be used for cased hole completions in oil and gas wells. It allows an operator to cement their production casing in place, establish injection by means of a wet shoe, and thereafter perform a mechanical integrity test on their production casing. This provides a reliable alternative to toe sleeves which are currently in use.

The advantages of pumping a wet shoe over a toe sleeve include increased reliability and enhanced flow. Many of the issues seen with toe sleeves stem from the fact that residual cement left in the wellbore after the cement wiper plug has passed cause the toe sleeve to either not function or plug off before reliably establishing an injection rate. Due to the fact that conventional casing wiper plugs are used in the present system and method, the wiping efficiency is greatly improved over those wiper plugs that are used for toe sleeve applications. Instead of relying on a mechanical device to properly function to re-establish injection into the formation, this system relies on a single dissolvable ball that is initially introduced to enable the test to be conducted and that is later removed by being dissolved trough contact with an aqueous solvent.

The casing wiper plug system of the present invention includes a bottom wiper plug, a newly configured top wiper plug, and the dissolvable blocking element. FIG. 1 depicts an illustrative bottom wiper plug 100 in accordance with some embodiments of the present invention. The bottom wiper plug 100 comprises a sealing nose 105 configured to be connected with a landing collar, a body 110 having one or more wiper fins 112 extending from an exterior surface 114 of the body, and a plug connector 115 configured to receive a sealing nose of the top wiper plug. The bottom wiper plug 100 also comprises a central bore 120 extending through the body and sealing nose to allow fluid flowing through the bottom wiper plug. The central bore 120 has a diameter of around 1" but may be different depending on the fracking job or the mechanical integrity test. The bottom wiper plug 100 further comprises a rupture disk or diaphragm 125 that closes off the central bore 120 and that is configured to withstand an amount of pressure and rupture when the pressure exerting on the rupture disk 125 exceeds a threshold pressure.

The bottom wiper plug 100 receives fluid from the plug connector end 115 or entry aperture 130 of the central bore and the fluid exits from the sealing nose end 105 or exit aperture 135 of the central bore. After the bottom wiper plug is introduced into the wellbore, the rupture disk 125 experiences pressure when fluid is introduced into the bottom wiper plug from the plug connector end and/or when additional component (e.g., top wiper plug) is introduced onto the bottom wiper plug. The pressure is generated by the weight, acceleration, gravity, and movement of the fluid and/or component and the confined space of the wellbore. When that pressure is above the threshold pressure of the rupture disk 125, the rupture disk 125 breaks and allows the fluid to pass through the central bore 120 or exit from the exit aperture 135. When that pressure is below or at the threshold pressure, the rupture disk 125 can support the fluid and does not break. The fluid is unable to flow through the entire central bore 120 or exit from the exit aperture 135.

The rupture disk 125 can be made of conventional material and manufactured to have a specific threshold burst pressure depending on the application and the type of fluid and component used. The burst pressure is typically around 400-psi (2.75-MPa). The rupture disk 125 is typically located in the center of the body 110 but it can also be installed in other locations within the bottom wiper plug 100 such as in the top or bottom of the body 110 or in the sealing nose 105, rather than roughly in the center of the body 110.

The bottom wiper plug 100 is essentially the same as other conventional wiper plugs that are known in the art.

FIG. 2 depicts an illustrative top wiper plug 200 in accordance with some embodiments of the present invention. The top wiper plug 200 comprises a sealing nose or forward portion 205 configured to be connected with the plug connector 115 of the bottom wiper plug 100, a body 210 having one or more wiper fins 212 extending from an exterior surface 214 of the body, and an open tail section 215 configured to receive the dissolvable blocking element. The top wiper plug 200 also comprises a central bore 220 extending through the body and sealing nose to allow fluid flowing therethrough. The top wiper plug 200 further comprises a rupture disk or diaphragm 225 that closes off the central bore 220 and that is configured to withstand an amount of pressure and rupture when the pressure exerting on the rupture disk 225 exceeds a threshold pressure, e.g., a burst pressure of 400-psi (2.75-MPa). These parts, except the open tail section 215, function and have dimensions similar to those described above for the bottom wiper plug. The same rupture disk may be used for both wiper plugs. Different rupture disks may also be used if desired, with the threshold pressure of the rupture disk 225 and the threshold pressure of the rupture disk 125 being the same or different.

The open tail section 215 preferably includes an interior structure 220 and a seat 225. The interior structure 220 narrows from a wider end or entry opening 235 of the open tail section 215 to a narrow end or bottom opening 240 of the interior structure 220 (or top opening 240 of the seat 225). The interior structure 220 defines an empty space that is in fluid or aerial communication with the seat 225 when the blocking element is not in the seat 225. The seat 225 is adjacent or in direct contact with the opening aperture 230 of the central bore 220. The seat 225 or the seat 225 and interior structure 220 is in fluid or aerial communication with the opening aperture 230. The seat is located between the interior structure 220 and the opening aperture 230. The open tail section 215 is designed so that it directs the blocking element into the seat 225 when the blocking element is dropped on the top wiper plug 200 in the wellbore. Although FIG. 2 shows a preferred interior structure or conical structure, the opening tail section 215 may have other structures that can direct the blocking element into the seat 225 after the blocking element contacting the open tail section 235. For example, the open tail section 215 may have a structure having a slope 245 that is curved into the open tail section 220 rather than a linear slope. It instead can have steps or other features that reduce the interior of the tail section as it approaches the seat 225. Although FIG. 2 also shows that the opening 235 is formed to its maximum size allowed by the diameter of the open tail section 230, the opening 235 may have a diameter smaller the diameter shown in the figure as long as the blocking element can be guided into the seat after the blocking element contacting the open tail section 235. The blocking element is configured to have a size corresponding to the dimensions of the interior structure 220 (or vice versa) to facilitate the movement into the seat 225. Generally, the blocking element or ball has a diameter that is slightly greater than the central bore but is not greater than 150% of the central bore. This provides good blocking of the bore to conduct the mechanical test while also facilitating dissolution of the element after the mechanical testing is complete.

The seat 225 is configured to receive the blocking element. The seat 225 includes a structure corresponding to the structure of the blocking element. The structure of the seat and the structure of the blocking element may be the same or different. When the blocking element is in the seat 225, the blocking element blocks the entry aperture 230 of the central bore 220 and the blocking element and the seat 225 provide sufficient seal for a mechanical integrity test or casing pressure test to be performed on the wellbore casing.

The top wiper plug 200 is not limited to attaching to the above-described bottom wiper plug and can be used with other conventional bottom wiper plugs. FIG. 2 depicts a top wiper plug in a wellbore or wellbore casing 280. The casing 280 has a diameter between 4 and 5 inches. The diameter of the casing 280 may have other ranges depending on the fracking job or the hydrocarbon extraction job.

FIG. 3 depicts an illustrative blocking element 300 in a top wiper plug 200 in accordance with some embodiments of the present invention. In particular, the blocking element 300 is a dissolvable blocking element that is dissolvable by a solvent. Dissolvable, removable, and similar terms mean that the material(s) used to produce the dissolvable blocking element is capable of dissolution in a solvent disposed within the wellbore casing. Dissolvable, removable, and similar terms are understood to encompass the terms degradable and disintegrable. The dissolvable material may be any material known to persons of ordinary skill in the art that can be dissolved, degraded, or disintegrate over an amount of time by the solvent alone or in combination with temperature and that can be calibrated such that the amount of time necessary for the dissolvable material to dissolve is known or easily determinable without undue experimentation. Suitable dissolvable material may include controlled electrolytic metallic nano-structured materials, polymers and biodegradable polymers (e.g., polyvinyl-alcohol based polymers, polylactide ("PLA") polymer 4060D, polycaprolactams and mixtures of PLA and polyglycolide ("PGA") polymers, solid acids (e.g., sulfamic acid, trichloroacetic acid, and citric acid, held together with a wax or other suitable binder material), polyethylene homopolymers and paraffin waxes, polyalkylene oxides (e.g., polyethylene oxides), polyalkylene glycols (e.g., polyethylene glycols), or any combination thereof. These polymers may be preferred in water-based fluids because they are soluble in water. The solvent may be aqueous solvent such as water-based fluid, hydrocarbon-based fluid, or the combination thereof. The solvent may also be a gas solvent.

In calibrating the rate of dissolution of dissolvable material, generally the rate is dependent on the molecular weight of the polymers. Acceptable dissolution rates can be achieved with a molecular weight range of 100,000 to 7,000,000. Thus, dissolution rates for a temperature range of 50° C. to 250° C. can be designed with the appropriate molecular weight or mixture of molecular weights.

The blocking element 300 generally has a diameter 360 between 1 and 1.5 inches provided that the diameter is no greater than about 1.5 times the diameter 365 of the central bore 320 of the top wiper plug 300. The diameter of the blocking element 300 is smaller than the diameter of the entry opening 335 of the open tail section 315. Preferably, the blocking element is a ball or has a spherical shape but it can be triangular, elliptical, square, or other shape. The blocking element 300 has a diameter that is sufficiently large to block the entry aperture 330 of the central bore 320 and that is sufficiently small to be dissolved readily. The minimum diameter, perimeter or size of the dissolvable blocking element is one that will prevent sufficient liquid from passing through the bore of the wiper plug in order to allow the mechanical integrity test to be conducted. The blocking element can be partially received past the seat and into the bore without affecting the operation of the invention. Also, the seat 325 is configured and dimensioned to help form the blockage and receive such sized dissolvable blocking element. Conveniently, a spherical blocking element is preferred as a portion of the ball or sphere will enter into the bore while another portion resides on the seat. The curvature of the blocking element allows the aqueous fluid to surround most of it to facilitate dissolution.

Figure 4:
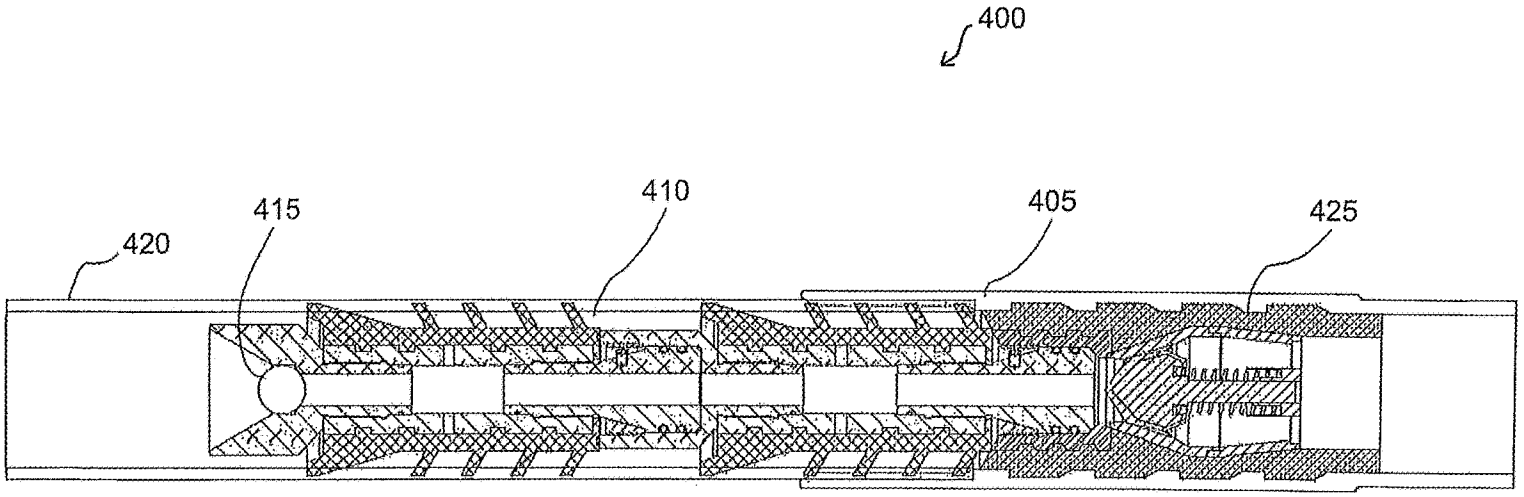
FIG. 4 depicts an illustrative casing wiper plug system the downhole end of the wellbore in accordance with some embodiments of the present invention.

FIG. 4 depicts a complete casing wiper plug system 400 when a bottom wiper plug 405 and a top wiper plug 410 containing a dissolvable blocking element 415 are connected together in a wellbore casing 420. Especially, the system 400 is in the downhole end of the wellbore. The bottom wiper plug 405 is connected to a landing collar 425 which is also known as a float collar. The landing collar 425 may or may not be part of the system 400. The landing collar has a central bore allowing fluid flow through. It also contains a corresponding profile to receive, seal and latch onto the bottom wiper plug nose. A mechanical integrity test or a casing pressure can be conducted on the wellbore casing 420 with the system 400 in the downhole end of the wellbore casing 420 and before dissolving the blocking element 415.

A method for operating the bottom wiper plug, top wiper plug, and dissolvable blocking element is contemplated and depicted in FIGS. 5 and 6. FIG. 5 shows an illustrative flow chart of the method 500 and FIGS. 6A, 6B and 6C show a pictorial flow chart corresponding to the flow chart in FIG. 5 using the actual components illustrated in FIGS. 1-3 in accordance with some embodiments of the present invention. Referring to FIGS. 5 and 6, the method 500 starts with introducing a bottom wiper plug 605 into the wellbore casing (step 505). Subsequently, a cement slurry 610 is pumped into the wellbore casing (step 510). The bottom wiper plug 605 acts a barrier between the cement slurry 565 and the drilling fluid that is already in the wellbore casing (i.e., the drilling fluid is injected into the wellbore casing before the bottom wiper plug is introduced.). Once a predetermined value of cement slurry has been pumped, the top wiper plug 615 is released from the ground surface (step 515). A displacement fluid 620 (e.g., treated water) is then pumped directly behind the top wiper plug 615 (step 520). Sufficient amount of displacement fluid and pressure are introduced into the wellbore casing to push the bottom wiper plug, along with the cement slurry and the top wiper plug above it, to fall to the downhole end or land on the landing collar.

A wiper plug is different from other plugs in that, once the wiper plug is inserted into the wellbore casing, the wiper fins exert force or create friction on the walls of the wellbore casing to prevent the wiper plug from or make the wiper plug more difficult falling to the downhole end or the landing collar. The force or friction on the walls permits the wiper plug to clean debris (e.g., debris on sections of the walls that the bottom wiper plug has not yet reached and will be scrubbed by the wiper fins of the bottom wiper plug) and cement slurry (e.g. residual cement slurry on the walls as the introduced cement slurry travels down the wellbore casing and will scrubbed by the wiper fins of the top wiper plug) on the walls. A wiper plug may not free fall in the wellbore casing by itself and generally requires external equipment, fluid, or pressure to drive the wiper plug to the downhole end or the landing collar. A wiper plug by itself may be configured to drop to the downhole end or the landing collar, but this requires waiting an undue period of time (e.g., days, weeks, or months) to complete and such delaying is unsuitable for cementing the wellbore casing and conducting a casing pressure test that typically necessitates done within hours. A wiper plug is also known as a cementing plug. Wiper fins are not the ordinary fasteners or joints on a plug, such those making connection with another plug or between components of the plug. Wiper fins are generally protrusions longer than the ordinary fasteners and joints (measured from the central bore) of the plug to deliberately exert force or create friction on the walls of the wellbore casing such that the ordinary fasteners and joints of the plug cannot contact the walls.

When the bottom wiper plug 605 reaches and connects with the landing collar 625 via the sealing nose 630 (step 525), the bottom wiper plug 605 is considered as landed. The rupture disk 635 and the sealing nose 630 of the bottom wiper plug 605 create a temporarily closed system (because fluid or air cannot exit from that rupture disk) which allows pressure above that rupture disk to 635 build-up. The pressure may refer to the pressure in the space between the bottom wiper plug or its rupture disk and the introduced cement slurry, the pressure of the introduced cement slurry, the pressure of the top wiper plug, the pressure of the displacement fluid, or a combination thereof. When the pressure increases to a value that exceeds the threshold pressure of the rupture risk 635, the rupture disk 635 ruptures (step 530) and allows the cement slurry 610 to flow through the central bore 640 of the bottom wiper plug 605 and exit from the exit aperture 645 of the sealing nose 630 (step 535). The cement slurry exited from the bottom wiper plug is provided through the landing collar to the shoe track and then to the annulus 650 between the open hole 655 and the wellbore casing 660 to cement the wellbore casing 660. The cement slurry is allowed to flow in this manner until the top wiper plug 615 above the cement slurry contacts the bottom wiper plug 605. The rupture risk 665 and the sealing nose 670 of the top wiper plug then creates a temporarily closed system allowing pressure above that rupture disk 665 to build up. The pressure may refer to the pressure in the space between the top wiper plug or its rupture disk and the displacement fluid, the pressure of the displacement fluid, or a combination thereof. When the pressure increases to a value that exceeds the threshold pressure of the rupture risk 665, the rupture disk 665 ruptures (step 540) and allows the displacement fluid 620 to flow through the central bore 670 of the top wiper plug and the central bore 640 of the bottom wiper plug and exit from the exit aperture 645 of the sealing nose of the bottom wiper plug (step 545). The displacement fluid helps remove debris on the walls of the central bore 670 of the top wiper plug and residual cement slurry on the walls of the central bore 640 of the bottom wiper plug. The displacement fluid 620 exited from the bottom wiper plug is provided through the landing collar 625 to the shoe track to push the cement slurry in the shoe track out of the shoe track. The shoe track then is free of or contains very little amount of cement slurry such that injection or fracking fluid can reach the hydrocarbon reservoir or formation 675 to satisfactorily conduct a hydraulic procedure. The central bore of the top wiper plug, the central bore of the bottom wiper plug, the landing collar, and the shoe track provide an open passage 680 allowing future injection or fracking fluid to reach the formation.

Subsequently, a mechanical integrity test or casing pressure test can performed (step 555) on the wellbore casing to determine whether the wellbore casing is properly cemented or has any flaws. Before the test is conducted (step 555), a dissolvable blocking element 680 is displaced from the ground surface and the dissolvable blocking element 680 is directed into the seat 685 in the open tail section 687 of the top wiper plug by the interior structure 689 in the open tail section (step 550). The dissolvable blocking element 680 blocks the entry aperture 691 of the central bore 670 of the top wiper plug or the aforementioned open passage 680 and the test is executed with the blockage formed therein. After the test is complete (step 555), the fluid used to displace the ball to seat works to dissolve the blocking element 680 (step 560). The blocking element 680 can dissolve quickly given the dimensions of the blocking element 680, the dimensions of the seat 685, and their dimensional relationship provided by the embodiments of the present invention. Dissolving the blocking element 680 reopens the passage 680 in the casing wiper plug system 695 allowing injection or fracking fluid to reach the formation 675.

Embodiments of present invention is an improvement over the prior systems and methods because they eliminate using a tubing-conveyed perforation gun or a toe sleeve or toe valve to gain access to the formation as described herein.

The term connect can mean directly connected (e.g., in physical contact) or indirectly connected (e.g., connected via intermediate components). The term wellbore casing refers to a production casing.

The term "about" when used herein indicates that the dimensions are not critical and can vary by ±15%.

It is understood that broader, narrower, or different combinations of the described features are contemplated, such that, for example features can be removed or added in a broadening or narrowing way. Applications of the technology to other fields are also contemplated.

Exemplary systems, components, methods, and steps are described for illustrative purposes. Further, since numerous modifications and changes will readily be apparent to those having ordinary skill in the art, it is not desired to limit the invention to the exact constructions as demonstrated in this disclosure. Accordingly, all suitable modifications and equivalents may be resorted to falling within the scope of the invention.

Thus, for example, any sequence(s) and/or temporal order of steps of various procedures, processes, or methods (or sequence of device connections or operation) that are described herein are illustrative and should not be interpreted as being restrictive. Accordingly, it should be understood that although steps of various procedures, processes, or methods or connections or sequence of operations may be shown and described as being in a sequence or temporal order, but they are not necessarily limited to being carried out in any particular sequence or order. For example, the steps in such procedures, processes, or methods generally may be carried out in various different sequences and orders, while still falling within the scope of the present invention. Moreover, in some discussions, it would be evident to those of ordinary skill in the art that a subsequent action, process, or feature is in response to an earlier action, process, or feature.

It should be understood that combinations of described features or steps are contemplated even if they are not described directly together or not in the same context.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

What is claimed is:

1. A method for conducting a mechanical integrity test to determine whether a wellbore casing can withstand fracking conditions, which comprises:

initially introducing a bottom wiper plug into a wellbore casing;

introducing into the wellbore casing a top wiper plug comprising a body having one or more wiper fins extending therefrom, a central bore having entry and exit apertures, a rupture disk for initially closing off the central bore, and an open tail section that includes an interior structure that narrows from a wider end at the open tail section to a narrower end at a seat structure adjacent the entry aperture of the central bore, wherein the seat structure is configured and dimensioned to receive a dissolvable blocking element that blocks the entry aperture of the central bore;

introducing a cement slurry into the wellbore casing after the bottom wiper plug is introduced and before the top wiper plug is introduced so that the cement slurry can be delivered to cement the wellbore casing to the wellbore;

introducing a dissolvable blocking element into the open tail section of the top wiper plug to temporarily block the central bore of the top wiper plug in order to allow the mechanical integrity test to be conducted, wherein the dissolvable blocking element is removable after the test is conducted by introducing a solvent into the wellbore casing that dissolves the dissolvable blocking element;

before introducing the dissolvable blocking element, rupturing the rupture disk of the top wiper plug to allow fluids to pass through the top wiper plug for cleaning of the central bore.

2. The method of claim 1, wherein the bottom wiper plug comprises a body having one or more wiper fins extending therefrom, a central bore having entry and exit apertures, a rupture disk for initially closing off the central bore, a sealing nose configured to be connected to a landing collar, and a plug connector.

3. The method of claim 2, further comprising rupturing the rupture disk of the bottom wiper plug to open the central bore to allow fluids to pass therethrough.

4. The method of claim 3, wherein the rupture disk of the bottom wiper plug is ruptured before the forward portion of the top wiper plug is received by the plug connector of the bottom wiper plug to allow fluids to pass therethrough.

5. The method of claim 1, wherein the open tail section of the top wiper plug has a conical interior structure and wherein the dissolvable blocking element has a diameter that is larger than but no greater than 1½ times the diameter of the central bore of the top wiper plug so that the blocking element is sufficiently large to block the central bore but sufficiently small to be dissolved readily.

6. The method of claim 2, wherein the top wiper plug further comprises a sealing nose configured to be connected with the bottom wiper plug and the plug connector of the bottom wiper plug is configured receive a forward portion of the top wiper plug.

7. The method of claim 1, wherein the interior structure of the top wiper plug has a conical structure.

8. The method of claim 1, wherein the dissolvable blocking element comprises a controlled electrolytic metallic nano-structured material, a polymer, a biodegradable polymer, a solid acid which is optionally held together with a wax or other binder material, a polyethylene homopolymer, a paraffin wax, a polyalkylene oxide, polyalkylene glycol, or any combination thereof.

9. The method of claim 1, wherein the dissolvable blocking element comprises sulfamic acid, trichloroacetic acid, or citric acid, optionally held together with a wax or other binder material; a polyvinyl-alcohol based polymer, a polylactide polymer or mixture with a polyglycolide polymer, a polycaprolactam polymer, a polyethylene oxide, a polyethylene glycol, or any combination thereof.

10. The method of claim 1, further comprising dissolving the dissolvable blocking element after conducting the test to re-open the central bore of the top wiper plug to allow fluids to flow through the central bore.

11. The method of claim 10, wherein the dissolvable blocking element is dissolved by contact with an aqueous solvent.

12. The method of claim 1, wherein the rupture disks of the top and bottom wiper plugs are initially configured to prevent fluids from passing through the central bores of the respective plugs.

13. The method of claim 1, wherein the rupture disks of the top and bottom plugs are breakable by fluids or fluid pressure at a selected burst pressure.

14. The method of claim 1, wherein the dissolvable blocking element is received in the seat structure of the top wiper plug.

* * * * *